US011796137B1

(12) United States Patent
Bai et al.

(10) Patent No.: US 11,796,137 B1
(45) Date of Patent: Oct. 24, 2023

(54) CORN LAMP CONVENIENT TO ASSEMBLE AND DISASSEMBLE

(71) Applicant: NINGBO JINGHUI OPTO-ELECTRONIC CO., LTD., Zhejiang Province (CN)

(72) Inventors: Guohui Bai, Zhejiang Province (CN); Xia Xiao, Zhejiang Province (CN); Guohuan Feng, Zhejiang Province (CN)

(73) Assignee: NINGBO JINGHUI OPTO-ELECTRONIC CO., LTD., Zhejiang Province (CN)

( * ) Notice: Subject to any disclaimer, the term of this patent is extended or adjusted under 35 U.S.C. 154(b) by 0 days.

(21) Appl. No.: 17/939,482

(22) Filed: Sep. 7, 2022

(30) Foreign Application Priority Data

May 16, 2022 (CN) ..... 202221167852.6

(51) Int. Cl.

| | |
|---|---|
| ***F21S 2/00*** | (2016.01) |
| ***F21K 9/232*** | (2016.01) |
| ***F21V 29/70*** | (2015.01) |
| *F21Y 107/30* | (2016.01) |

(52) U.S. Cl.
CPC ..... *F21K 9/232* (2016.08); *F21V 29/70* (2015.01); *F21Y 2107/30* (2016.08)

(58) Field of Classification Search
CPC .... F21S 2/005; F21S 2/00; F21S 8/083; F21S 4/28; F21V 21/005; F21V 21/00; F21V 29/70; F21V 23/06; F21V 15/015; F21Y 2107/30; F21K 9/232
See application file for complete search history.

(56) References Cited

U.S. PATENT DOCUMENTS

2015/0201261 A1* 7/2015 Feller ..... F21V 21/02 381/395
2018/0300995 A1* 10/2018 Dolezalek ..... G08B 7/06

FOREIGN PATENT DOCUMENTS

EP 2320126 A1 * 5/2011 ..... F21S 8/00

* cited by examiner

*Primary Examiner* — Omar Rojas Cadima
(74) *Attorney, Agent, or Firm* — Tarolli, Sundheim, Covell & Tummino, LLP

(57) ABSTRACT

A corn lamp is provided includes a lamp body assembly having a mounting lamp holder, a connecting bracket and a lamp cap. A lamp source module is mounted on the mounting lamp holder. The connecting bracket is arranged between the mounting lamp holder and the lamp cap. The mounting lamp holder is fixed with the lamp cap through the connecting bracket. A mounting base for mounting other external lamp bodies is arranged on an inner side of the mounting lamp holder. A first mounting cavity corresponding to the lamp cap is formed on an inner side of the mounting base, and the mounting base is detachably connected with lamp caps of other external lamp bodies through threads. The corn lamp is convenient to assemble and disassemble. A plurality of lamp body assemblies can be assembled and disassembled to meet the lighting requirements of different scenes.

9 Claims, 6 Drawing Sheets

CORN LAMP CONVENIENT TO ASSEMBLE AND DISASSEMBLE

CROSS-REFERENCE TO RELATED APPLICATION

This patent application claims the benefit and priority of Chinese Patent Application No. 202221167852.6, filed on May 16, 2022, the disclosure of which is incorporated by reference herein in its entirety as part of the present application.

TECHNICAL FIELD

The present invention relates to a corn lamp, and particularly relates to a corn lamp convenient to assemble and disassemble.

BACKGROUND ART

A corn lamp is a lamp capable of emitting light all around, and main illuminants are LED lamp beads. In order to enable the lamp to emit light all around, a plurality of LED lamp beads are arranged in a surrounding distribution mode. LED lamps have the characteristics of energy saving, long service life, small size, good shock resistance, etc., and are suitable for various scenes such as indication, display, decoration, general lighting and urban night scenes. The LED lamp beads are connected with an electronic driving element in a lamp cap, and are driven by the electronic driving element to emit light. Some existing corn lamps are complex in structures, complicated in assembly steps and troublesome in disassembly and assembly, so that the assembly cost and the maintenance cost are increased. In the existing corn lamps, a plurality of independent lamp bodies can not be assembled, so that in some occasions with high brightness requirements, it is necessary to increase the power of the lamp beads or use a plurality of lamp bodies for lighting. The power of the lamp beads is a fixed power and can not be adjusted, so it is necessary to replace high-power corn lamp products, which increases the use cost and is troublesome in replacement. If a plurality of lamp bodies are used for lighting, a plurality of lamp bases for mounting the lamp bodies need to be correspondingly arranged, which also increases the use cost and is inconvenient for use.

Semiconductor chips in the LED lamp beads generate heat in the process of energizing and emitting light, and the heat accumulation causes the temperature of the lamp to rise. The excessive temperature interferes with the normal operation of the electronic driving element, reduces the luminous efficiency of the LED lamp beads, and accelerates the damage of components, so that the service life of the lamp is shortened. A plurality of LED lamp beads are distributed around the corn lamp in a relatively dense mode, resulting in a higher heat generation density, which further increases the difficulty of dissipating heat to the outside.

SUMMARY OF THE INVENTION

(1) Technical Problem to be Solved

The problem to be solved by the present invention is to provide a corn lamp convenient to assemble and disassemble with a simple structure and low production cost. A plurality of lamp body assemblies can be assembled and disassembled according to requirements so as to meet the lighting requirements of different scenes, the use cost is low, and the disassembly and assembly are convenient. The lamp body has a good heat dissipation effect and a long service life.

(2) Technical Solution

In order to solve the technical problem, the present invention provides a corn lamp convenient to assemble and disassemble, including a lamp body assembly. The lamp body assembly includes a mounting lamp holder, a connecting bracket and a lamp cap. A lamp source module is mounted on the mounting lamp holder, the connecting bracket is arranged between the mounting lamp holder and the lamp cap, the mounting lamp holder is fixed with the lamp cap through the connecting bracket, a mounting base for mounting other external lamp bodies is arranged on an inner side of the mounting lamp holder, a first mounting cavity corresponding to the lamp cap is formed on an inner side of the mounting base, the mounting base is detachably connected with lamp caps of other external lamp bodies through threads, and the disassembly and assembly are convenient. A plurality of lamp bodies with the same power or different power can be assembled according to scene requirements so as to meet different lighting requirements, the use range is wide, the use is convenient, and the use cost is reduced. The lamp body assembly can be used alone for lighting according to requirements, or two or more lamp body assemblies can be assembled for use, so that the use is more flexible.

According to the corn lamp convenient to assemble and disassemble in the present invention, a buckle mechanism is arranged between a second lamp body assembly and a bottom cover, buckle parts are arranged on the bottom cover, and slots are arranged on the mounting lamp holder of the second lamp body assembly, so that the bottom cover is convenient to disassemble and assemble. A plurality of buckle parts are provided, and the plurality of buckle parts are annularly arranged on the bottom cover at equal intervals, so that the bottom cover is mounted more stably. The structure is simple, and the production cost is low. A plurality of lamp body assemblies can be assembled and disassembled according to requirements so as to meet the lighting requirements of different scenes, the use cost is low, and the disassembly and assembly are convenient. The lamp body has a good heat dissipation effect and a long service life. An annular bracket is made of a transparent plastic material, so that the lighting effect is good. The lamp cap is fixedly connected with the connecting bracket through bolts, and the connecting bracket is fixedly connected with the mounting lamp holder through bolts, so that the disassembly and assembly are convenient. The annular bracket is provided with a plurality of heat dissipation through grooves for heat dissipation of the lamp source module, and the plurality of heat dissipation through grooves are annularly arranged on the annular bracket at equal intervals, so that the heat dissipation effect is good, and the service life is long.

Further, the mounting lamp holder includes an annular bracket and the mounting base, the annular bracket and the mounting base are integrally formed, the mounting base is arranged on an inner side of the annular bracket, a second mounting cavity for mounting the lamp source module is formed between the annular bracket and the mounting base, and the mounting is convenient.

Further, the annular bracket is provided with a plurality of heat dissipation through grooves for heat dissipation of the lamp source module, and the plurality of heat dissipation through grooves are annularly arranged on the annular bracket at equal intervals, so that the heat dissipation effect is good, and the service life is long. The heat dissipation through groove is a rectangular through groove.

Further, the lamp cap is fixedly connected with the connecting bracket through bolts, and the connecting bracket is fixedly connected with the mounting lamp holder through bolts, so that the disassembly and assembly are convenient.

Further, an upper end of the lamp cap is provided with external threads, and the mounting base is provided with internal threads corresponding to the external threads, so that the disassembly and assembly are convenient. The lamp cap includes a tapered part, and the first mounting cavity is set as a tapered cavity corresponding to the tapered part, so that the mounting is convenient.

Further, the lamp source module includes a plurality of LED lamp beads, and the plurality of LED lamp beads are correspondingly arranged at the heat dissipation through grooves, so that the lighting effect is good, and the heat dissipation performance is good. The lamp source module is an annular lamp panel or an annular lamp strip, so that the lighting effect is good.

Further, the annular bracket is made of a transparent plastic material, so that the lighting effect is good.

Further, the lamp body assembly includes a first lamp body assembly and a second lamp body assembly, and the second lamp body assembly is detachably mounted on a bottom of the first lamp body assembly. A bottom cover is detachably arranged at a lower end of the second lamp body assembly, a buckle mechanism is arranged between the second lamp body assembly and the bottom cover, the buckle mechanism includes buckle parts and slots corresponding to the buckle parts, the buckle parts are arranged on the bottom cover, and the slots are arranged on the mounting lamp holder of the second lamp body assembly, so that the bottom cover is convenient to disassemble and assemble. The first lamp body assembly and the second lamp body assembly can be selected from lamp body assemblies with the same structure, or can be selected from lamp body assemblies with different structures. When lamp body assemblies with different structures are selected, the bottom of the first lamp body assembly can be connected with lamps having screw sockets of other structures through threads, so that the use is more flexible.

Further, a plurality of buckle parts are provided, and the plurality of buckle parts are annularly arranged on the bottom cover at equal intervals, so that the bottom cover is mounted more stably.

(3) Beneficial Effects

The corn lamp convenient to assemble and disassemble in the present invention is simple in structure and low in production cost. A plurality of lamp body assemblies can be assembled and disassembled according to requirements so as to meet the lighting requirements of different scenes, the use cost is low, and the disassembly and assembly are convenient. The lamp body has a good heat dissipation effect and a long service life. The annular bracket is made of a transparent plastic material, so that the lighting effect is good. The lamp cap is fixedly connected with the connecting bracket through bolts, and the connecting bracket is fixedly connected with the mounting lamp holder through bolts, so that. The annular bracket is provided with a plurality of heat dissipation through grooves for heat dissipation of the lamp source module, and the plurality of heat dissipation through grooves are annularly arranged on the annular bracket at equal intervals, so that the heat dissipation effect is good, and the service life is long. The buckle mechanism is arranged between the second lamp body assembly and the bottom cover, the buckle parts are arranged on the bottom cover, and the slots are arranged on the mounting lamp holder of the second lamp body assembly, so that the bottom cover is convenient to disassemble and assemble. A plurality of buckle parts are provided, and the plurality of buckle parts are annularly arranged on the bottom cover at equal intervals, so that the bottom cover is mounted more stably.

Figure 1:
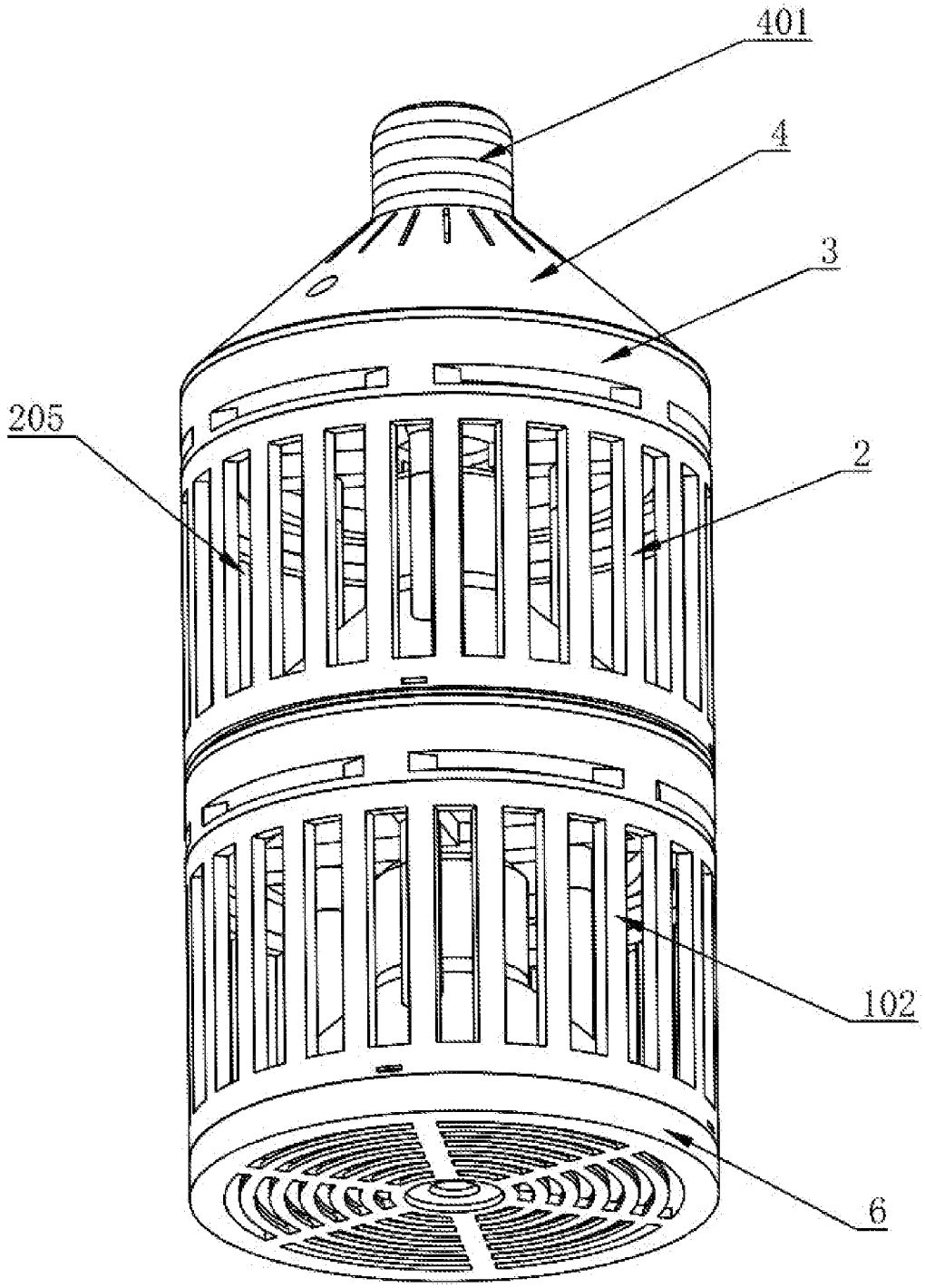
FIG. 1 is a perspective view of a corn lamp convenient to assemble and disassemble in the present invention.
Figure 2:
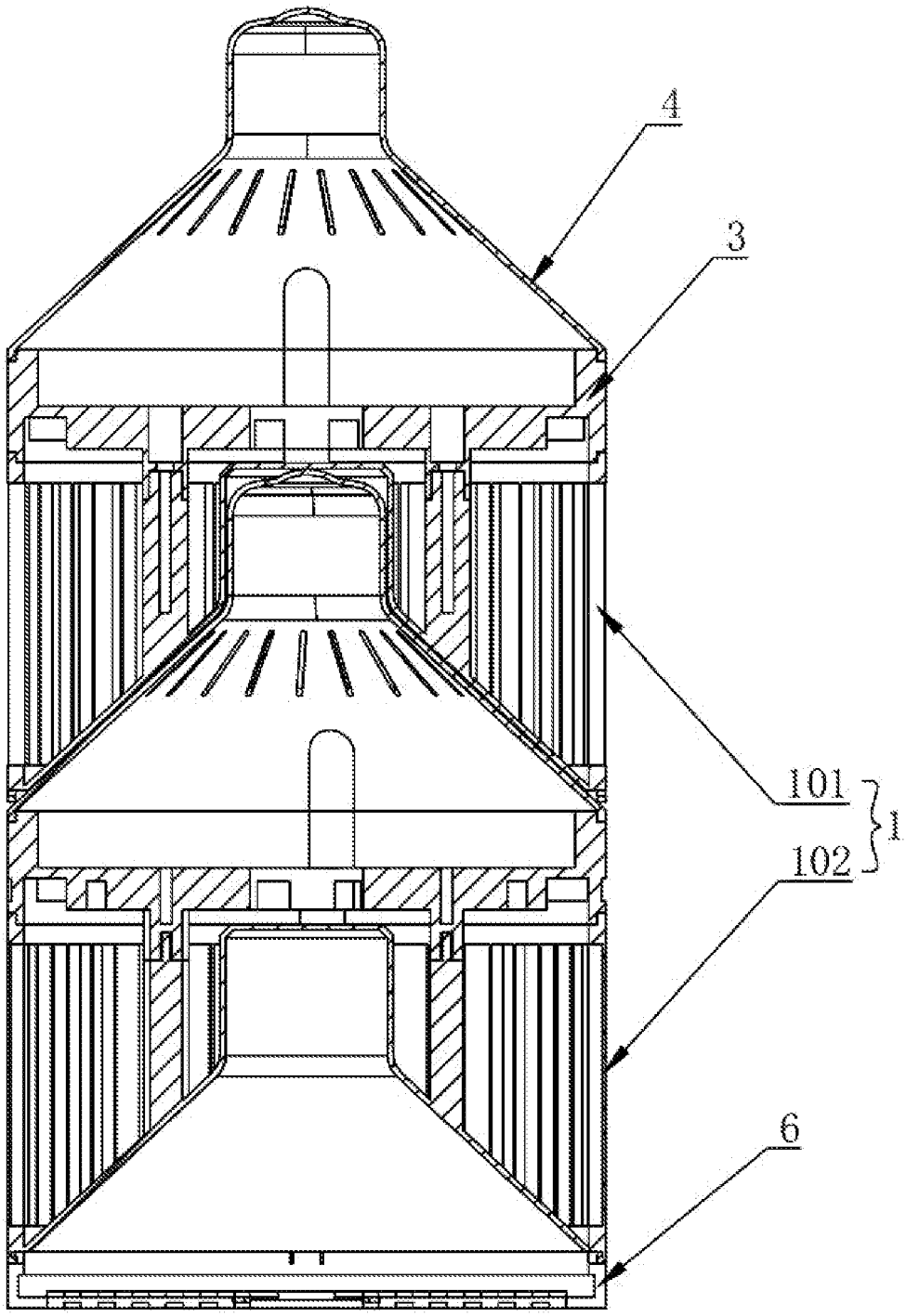
FIG. 2 is a cross-sectional view of the corn lamp convenient to assemble and disassemble in the present invention.
Figure 3:
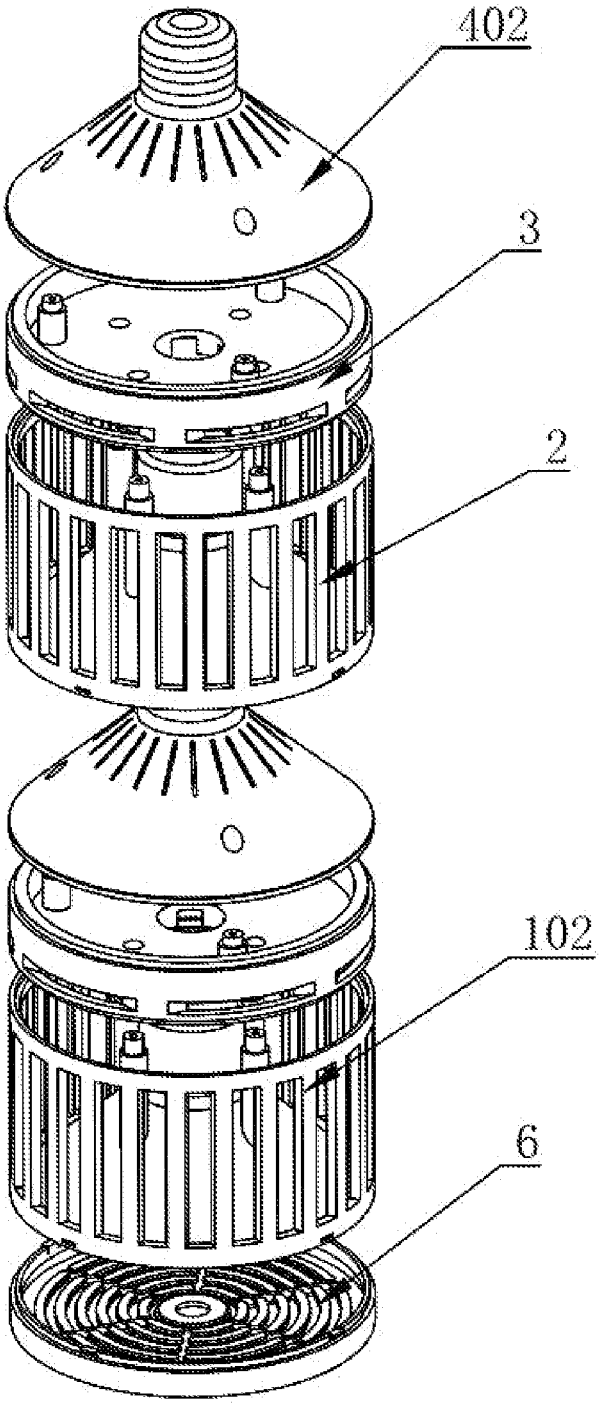
FIG. 3 is an exploded view of the corn lamp convenient to assemble and disassemble in the present invention.

The names of the parts corresponding to respective reference numbers in the figures are: 1 represents lamp body assembly, 101 represents first lamp body assembly, 102 represents second lamp body assembly, 2 represents mounting lamp holder, 201 represents mounting base, 202 represents first mounting cavity, 203 represents annular bracket, 204 represents second mounting cavity, 205 represents heat dissipation through groove, 206 represents internal threads, 3 represents connecting bracket, 4 represents lamp cap, 401 represents external threads, 402 represents tapered part, 5 represents lamp source module, 501 represents LED lamp bead, 6 represents bottom cover, 7 represents buckle part, 8 represents slot.

DETAILED DESCRIPTION OF THE INVENTION

The specific embodiments of the present invention will be further described in detail below with reference to the accompanying drawings and examples. The following examples are intended to illustrate the present invention, but are not intended to limit the scope of the present invention.

Referring to FIG. 1 to FIG. 6, the present invention provides a corn lamp convenient to assemble and disassemble, including a lamp body assembly 1. The lamp body assembly 1 includes a mounting lamp holder 2, a connecting bracket 3 and a lamp cap 4. A lamp source module 5 is mounted on the mounting lamp holder 2, the connecting bracket 3 is arranged between the mounting lamp holder 2 and the lamp cap 4, the mounting lamp holder 2 is fixed with the lamp cap 4 through the connecting bracket 3, a mounting base 201 for mounting other external lamp bodies is arranged on an inner side of the mounting lamp holder 2, a first mounting cavity 202 corresponding to the lamp cap 4 is formed on an inner side of the mounting base 201, the mounting base 201 is detachably connected with lamp caps of other external lamp bodies through threads, and the disassembly and assembly are convenient. A plurality of lamp bodies with the same power or different power can be assembled according to scene requirements so as to meet different lighting requirements, the use range is wide, the use is convenient, and the use cost is reduced. The lamp body assembly can be used alone for lighting according to requirements, or two or more lamp body assemblies can be assembled for use, so that the use is more flexible.

According to the corn lamp convenient to assemble and disassemble in the present invention, an annular bracket is provided with a plurality of heat dissipation through grooves for heat dissipation of the lamp source module, and the plurality of heat dissipation through grooves are annularly arranged on the annular bracket at equal intervals, so that the heat dissipation effect is good, and the service life is long. A buckle mechanism is arranged between a second lamp body assembly and a bottom cover, buckle parts are arranged on the bottom cover, and slots are arranged on the mounting lamp holder of the second lamp body assembly, so that the bottom cover is convenient to disassemble and assemble. A plurality of buckle parts are provided, and the plurality of buckle parts are annularly arranged on the bottom cover at equal intervals, so that the bottom cover is mounted more stably. The structure is simple, and the production cost is low. A plurality of lamp body assemblies can be assembled and disassembled according to requirements so as to meet the lighting requirements of different scenes, the use cost is low, and the disassembly and assembly are convenient. The lamp body has a good heat dissipation effect and a long service life. The annular bracket is made of a transparent plastic material, so that the lighting effect is good. The lamp cap is fixedly connected with the connecting bracket through bolts, and the connecting bracket is fixedly connected with the mounting lamp holder through bolts, so that the disassembly and assembly are convenient.

Figure 4:
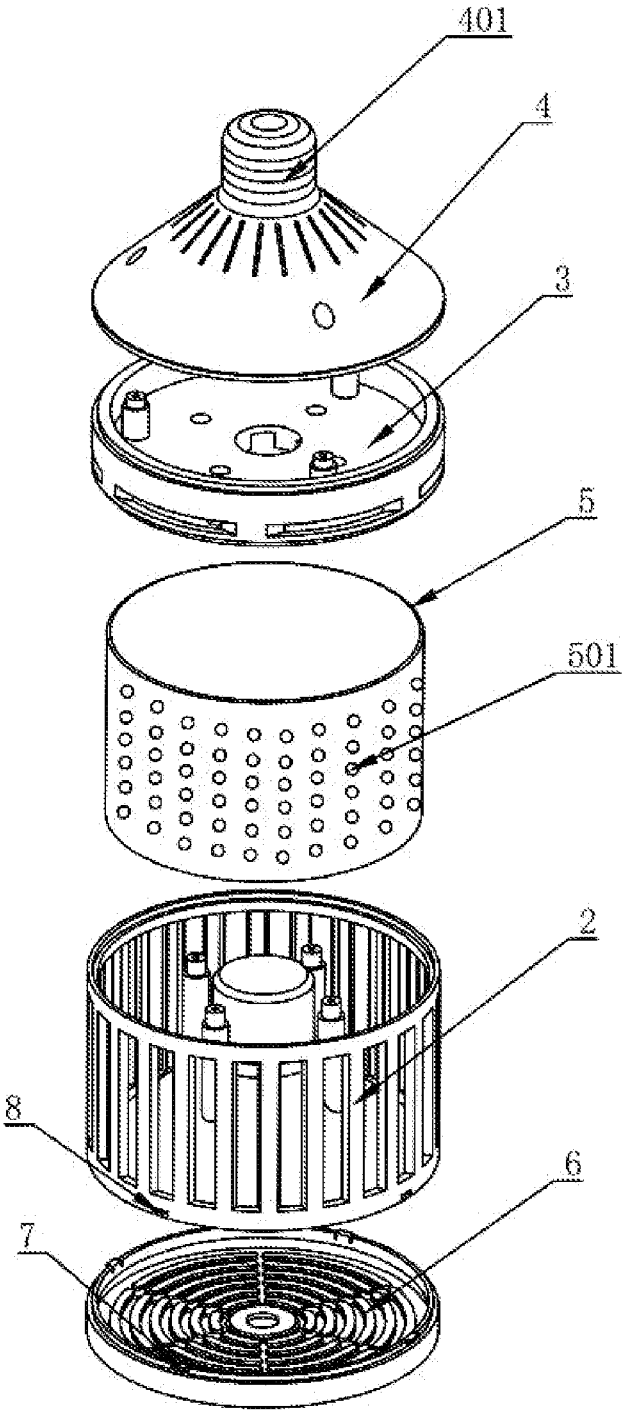
FIG. 4 is a schematic structural view of a lamp source module of the corn lamp convenient to assemble and disassemble in the present invention.
Figure 5:
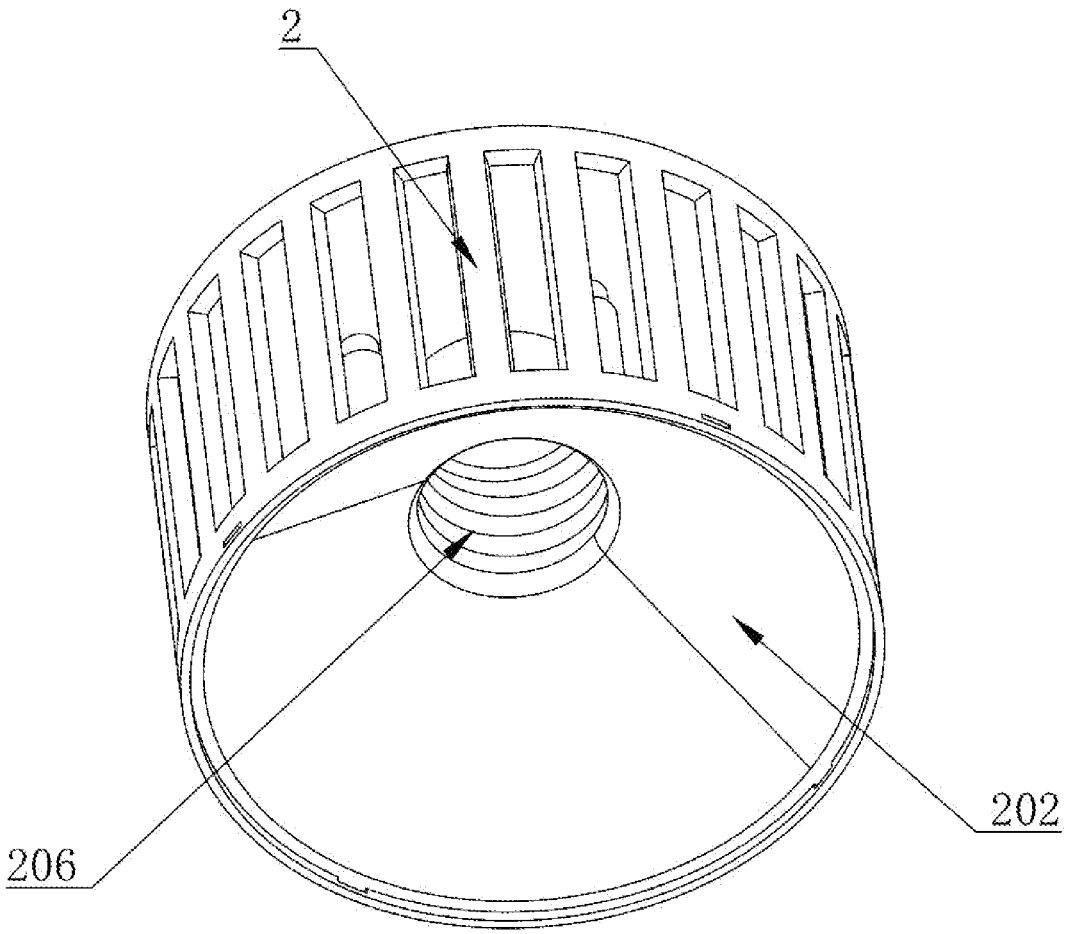
FIG. 5 is a perspective view of a bottom of a mounting lamp holder of the corn lamp convenient to assemble and disassemble in the present invention.
Figure 6:
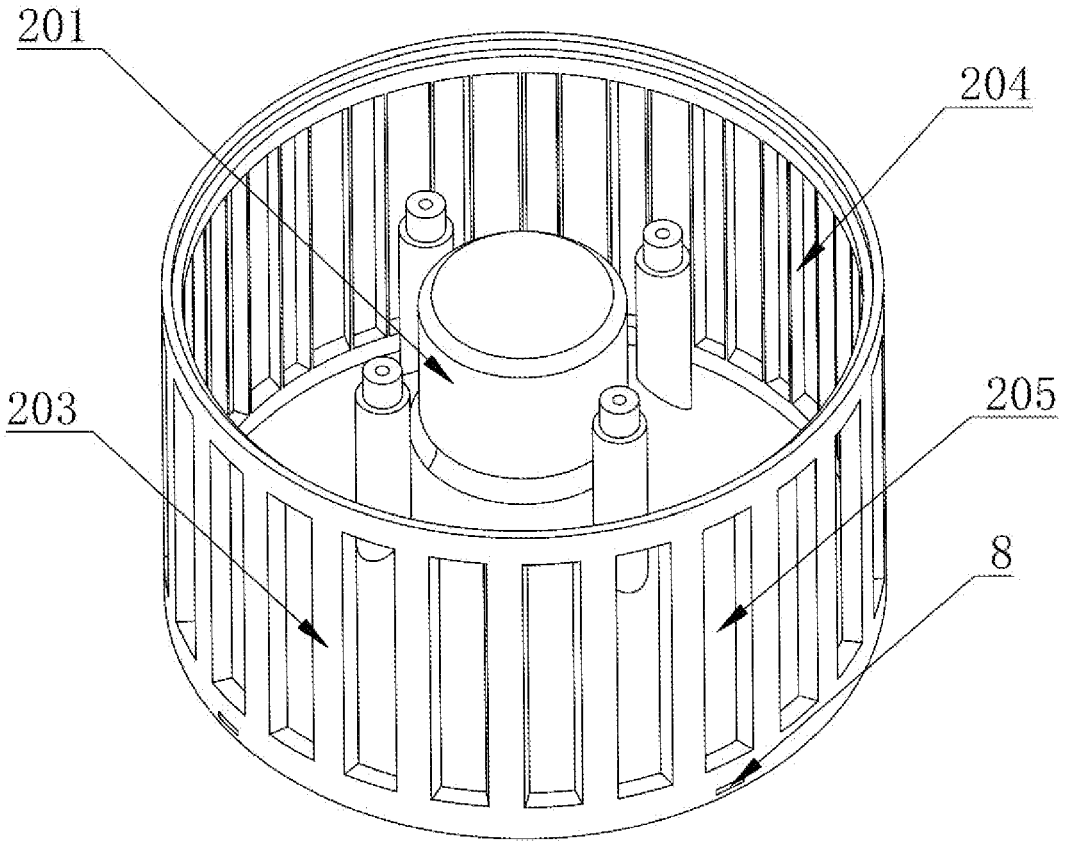
FIG. 6 is a schematic structural view of the mounting lamp holder of the corn lamp convenient to assemble and disassemble in the present invention.

Referring to FIG. 1, FIG. 4 and FIG. 6, the mounting lamp holder 2 includes an annular bracket 203 and the mounting base 201, the annular bracket 203 and the mounting base 201 are integrally formed, the mounting base 201 is arranged on an inner side of the annular bracket 203, a second mounting cavity 204 for mounting the lamp source module 5 is formed between the annular bracket 203 and the mounting base 201, and the mounting is convenient.

Referring to FIG. 1 to FIG. 5, the annular bracket 203 is provided with a plurality of heat dissipation through grooves 205 for heat dissipation of the lamp source module 5, and the plurality of heat dissipation through grooves 205 are annularly arranged on the annular bracket 203 at equal intervals, so that the heat dissipation effect is good, and the service life is long. The heat dissipation through groove 205 is a rectangular through groove. The lamp cap 4 is fixedly connected with the connecting bracket 3 through bolts, and the connecting bracket 3 is fixedly connected with the mounting lamp holder 2 through bolts, so that the disassembly and assembly are convenient. An upper end of the lamp cap 4 is provided with external threads 401, and the mounting base 201 is provided with internal threads 206 corresponding to the external threads 401, so that the disassembly and assembly are convenient. The lamp cap 4 includes a tapered part 402, and the first mounting cavity 202 is set as a tapered cavity corresponding to the tapered part 402, so that the mounting is convenient.

Referring to FIG. 1 and FIG. 4, the lamp source module 5 includes a plurality of LED lamp beads 501, and the plurality of LED lamp beads 501 are correspondingly arranged at the heat dissipation through grooves 205, so that the LED lamp beads 501 can penetrate through the heat dissipation through grooves 205 for lighting, the lighting effect is good, and the heat dissipation performance is good. The lamp source module 5 is an annular lamp panel or an annular lamp strip, so that the lighting effect is good. The annular bracket 203 is made of a transparent plastic material, so that the lighting effect is good.

Referring to FIG. 1 to FIG. 4, the lamp body assembly 1 includes a first lamp body assembly 101 and a second lamp body assembly 102, and the second lamp body assembly 102 is detachably mounted on a bottom of the first lamp body assembly 101. A bottom cover 6 is detachably arranged at a lower end of the second lamp body assembly 102, a buckle mechanism is arranged between the second lamp body assembly 102 and the bottom cover 6, the buckle mechanism includes buckle parts 7 and slots 8 corresponding to the buckle parts 7, the buckle parts 7 are arranged on the bottom cover 6, and the slots 8 are arranged on the mounting lamp holder 2 of the second lamp body assembly 102, so that the bottom cover is convenient to disassemble and assemble. A plurality of buckle parts 7 are provided, and the plurality of buckle parts 7 are annularly arranged on the bottom cover 6 at equal intervals, so that the bottom cover is mounted more stably. The first lamp body assembly and the second lamp body assembly can be selected from lamp body assemblies with the same structure, or can be selected from lamp body assemblies with different structures. When lamp body assemblies with different structures are selected, the bottom of the first lamp body assembly can be connected with lamps having screw sockets of other structures through threads, so that the use is more flexible.

According to the corn lamp convenient to assemble and disassemble in the present invention, the lamp cap is fixedly connected with the connecting bracket through bolts, and the connecting bracket is fixedly connected with the mounting lamp holder through bolts, so that the disassembly and assembly are convenient. The annular bracket is provided with a plurality of heat dissipation through grooves for heat dissipation of the lamp source module, and the plurality of heat dissipation through grooves are annularly arranged on the annular bracket at equal intervals, so that the heat dissipation effect is good, and the service life is long. The buckle mechanism is arranged between the second lamp body assembly and the bottom cover, the buckle parts are arranged on the bottom cover, and the slots are arranged on the mounting lamp holder of the second lamp body assembly, so that the bottom cover is convenient to disassemble and assemble. A plurality of buckle parts are provided, and the plurality of buckle parts are annularly arranged on the bottom cover at equal intervals, so that the bottom cover is mounted more stably. The structure is simple, and the production cost is low. A plurality of lamp body assemblies can be assembled and disassembled according to requirements so as to meet the lighting requirements of different scenes, the use cost is low, and the disassembly and assembly are convenient. The lamp body has a good heat dissipation effect and a long service life. The annular bracket is made of a transparent plastic material, so that the lighting effect is good.

The above are only the preferred embodiments of the present invention. It should be noted that those skilled in the art can make several improvements and modifications without departing from the technical principle of the present invention, and these improvements and modifications should also be regarded as the protection scope of the present invention.

What is claimed:

1. A corn lamp convenient to assemble and disassemble, comprising:

a lamp body assembly, wherein the lamp body assembly comprises a mounting lamp holder, a connecting bracket and a lamp cap, wherein a lamp source module is mounted on the mounting lamp holder, the connecting bracket is arranged between the mounting lamp holder and the lamp cap, the mounting lamp holder is fixed with the lamp cap through the connecting bracket, a mounting base for mounting other external lamp body assembly is arranged on an inner side of the mounting lamp holder, a first mounting cavity corresponding to the lamp cap is formed on an inner side of the mounting base, and the mounting base is detachably connected with a lamp cap of the other external lamp body assembly through threads, wherein the lamp cap is fixedly connected with the connecting bracket through bolts, and the connecting bracket is fixedly connected with the mounting lamp holder through other bolts.

2. The corn lamp convenient to assemble and disassemble according to claim 1, wherein the mounting lamp holder comprises an annular bracket and the mounting base, the annular bracket and the mounting base are integrally formed, the mounting base is arranged on an inner side of the annular bracket, and a second mounting cavity for mounting the lamp source module is formed between the annular bracket and the mounting base.

3. The corn lamp convenient to assemble and disassemble according to claim 2, wherein the annular bracket is provided with a plurality of heat dissipation through grooves for heat dissipation of the lamp source module, the plurality of heat dissipation through grooves are annularly arranged on the annular bracket at equal intervals, and the heat dissipation through groove is a rectangular through groove.

4. The corn lamp convenient to assemble and disassemble according to claim 3, wherein the lamp source module comprises a plurality of LED lamp beads, the plurality of LED lamp beads are correspondingly arranged at the heat dissipation through grooves, and the lamp source module is an annular lamp panel or an annular lamp strip.

5. The corn lamp convenient to assemble and disassemble according to claim 2, wherein the annular bracket is made of a transparent plastic material.

6. The corn lamp convenient to assemble and disassemble according to claim 2, wherein the lamp body assembly comprises a first lamp body assembly and a second lamp body assembly, and the second lamp body assembly is detachably mounted on a bottom of the first lamp body assembly.

7. The corn lamp convenient to assemble and disassemble according to claim 6, wherein a bottom cover is detachably arranged at a lower end of the second lamp body assembly, a buckle mechanism is arranged between the second lamp body assembly and the bottom cover, the buckle mechanism comprises buckle parts and slots corresponding to the buckle parts, the buckle parts are arranged on the bottom cover, and the slots are arranged on the mounting lamp holder of the second lamp body assembly.

8. The corn lamp convenient to assemble and disassemble according to claim 7, wherein a plurality of buckle parts are provided, and the plurality of buckle parts are annularly arranged on the bottom cover at equal intervals.

9. The corn lamp convenient to assemble and disassemble according to claim 1, wherein an upper end of the lamp cap is provided with external threads, the mounting base is provided with internal threads corresponding to the external threads; the lamp cap comprises a tapered part, and the first mounting cavity is set as a tapered cavity corresponding to the tapered part.

* * * * *